US006708835B1

(12) United States Patent
Mathis

(10) Patent No.: US 6,708,835 B1
(45) Date of Patent: Mar. 23, 2004

(54) EXTENDABLE BASKET AND KIT

(76) Inventor: Derrick Mathis, 439 Delaware St., Grand Rapids, MI (US) 49507

( * ) Notice: Subject to any disclaimer, the term of this patent is extended or adjusted under 35 U.S.C. 154(b) by 0 days.

(21) Appl. No.: 10/156,344

(22) Filed: May 28, 2002

Related U.S. Application Data

(60) Provisional application No. 60/294,118, filed on May 29, 2001.

(51) Int. Cl.[7] ..... B65D 21/08

(52) U.S. Cl. ..... 220/4.03; 150/154; 217/124; 220/9.4

(58) Field of Search ..... 220/4.03, 287, 220/908.3, 9.4; 150/154, 159; 190/103, 110; 217/76, 122, 124; 141/337, 338, 391; 2/16; 193/25 R; 206/315.9

(56) References Cited

U.S. PATENT DOCUMENTS

| | | | | | |
|---|---|---|---|---|---|
| 595,685 | A | | 12/1897 | Abraham | |
| 719,819 | A | * | 2/1903 | Leigh | 217/53 |
| 882,935 | A | * | 3/1908 | Engel | 217/122 |
| 1,341,099 | A | * | 5/1920 | Abramson | 190/103 |
| 1,636,679 | A | * | 7/1927 | Burch et al. | 193/7 |
| 1,653,556 | A | | 12/1927 | Faber | |
| 1,691,904 | A | * | 11/1928 | Gamble | 206/8 |
| 1,725,864 | A | | 8/1929 | James | |
| 2,073,914 | A | * | 3/1937 | Wilfley | 141/314 |
| 2,212,390 | A | | 8/1940 | Conklin | |
| 2,323,318 | A | | 7/1943 | Farkas | |
| 3,349,936 | A | | 10/1967 | Morton et al. | |
| 3,432,869 | A | * | 3/1969 | Jurik et al. | 12/145 |
| 3,692,072 | A | * | 9/1972 | Kohls | 141/391 |
| 4,089,070 | A | * | 5/1978 | Cherry | 2/161.2 |
| 4,424,841 | A | * | 1/1984 | Smith | 224/240 |
| 4,953,697 | A | * | 9/1990 | Stanley | 206/315.4 |
| D356,194 | S | | 3/1995 | Messina | |
| 5,439,727 | A | * | 8/1995 | Riggs et al. | 428/128 |
| D364,736 | S | * | 12/1995 | Kerr | D3/226 |
| 5,582,219 | A | * | 12/1996 | Claar et al. | 141/93 |
| 5,839,631 | A | * | 11/1998 | Hebert et al. | 224/251 |
| 6,305,590 | B1 | * | 10/2001 | Hayes | 224/413 |
| 6,497,317 | B1 | * | 12/2002 | Chun | 193/25 R |

FOREIGN PATENT DOCUMENTS

| | | |
|---|---|---|
| DE | 919269 | 10/1954 |
| GB | 17474 | 11/1888 |
| IT | 530771 | 3/1955 |

* cited by examiner

*Primary Examiner*—Lee Young
*Assistant Examiner*—Joseph C. Merek
(74) *Attorney, Agent, or Firm*—Van Dyke, Gardner, Linn & Burkhart, LLP

(57) ABSTRACT

An extendable basket and kit for making an extendable basket are disclosed. The extendable basket includes an ordinary basket, such as a laundry basket, and a fabric extension that can be secured generally about the perimeter of the basket. The fabric extension extends outwardly from the basket and increases the effective carrying capacity of the basket. The fabric extension may be releasably secured to the basket via clips, or other means. The fabric extension may include a drawstring with a locking mechanism. The kit may include the fabric extension and a selected number of fasteners.

7 Claims, 2 Drawing Sheets

EXTENDABLE BASKET AND KIT

Cross-Reference to Related Applications

This application claims priority to U.S. Provisional Application Ser. No. 60/294,118, filed May 29, 2001 and entitled Extendable Basket and Kit, the disclosure of which is hereby incorporated herein by reference.

BACKGROUND OF THE INVENTION

In the past, the carrying of items in baskets has often been limited by the height of the side walls of the basket such that items cannot safely be stacked higher than the height of these side walls. This is especially true with respect to laundry baskets in which stacking the laundry higher than the sides of the laundry basket tended to invite the uppermost laundry from spilling out of the basket, especially when the basket was jostled during transportation. Moreover, due to the open nature of the top of the basket, even laundry that didn't exceed the heights of the side walls still suffered from potentially being spilled when the basket was tipped. In order to minimize the risk of this spilling, it has been necessary in the past to divide the contents being carried into multiple baskets such that each basket carries only a portion of the total items to be stored or transported. A need can therefore be seen for an improved basket that overcomes these and other disadvantages.

SUMMARY OF THE INVENTION

Accordingly, an extendable basket and kit according to the present invention provides an improved basket that allows more items to be placed in, and transported by, the basket. The kit is easily assembled onto existing baskets, such as laundry baskets, and can be easily removed when its use is not desired. The extendable basket includes a flexible extension material, such as cloth, nylon, or other materials, which is affixed generally around the perimeter of a basket. The extension material extends vertically higher than the height of the basket's side walls, thereby allowing the items to be stacked higher in the basket while being retained in the basket by the extension material. The extension material may include a drawstring or other tightening means for securing the top end of the extension material to prevent items from escaping out of the basket. The extension material may also be secured to the basket by release structures that allow the extension material to be easily removed and reattached as desired by the user.

BRIEF DESCRIPTION OF THE PHOTOS

DETAILED DESCRIPTION OF THE INVENTION

Figure 1:
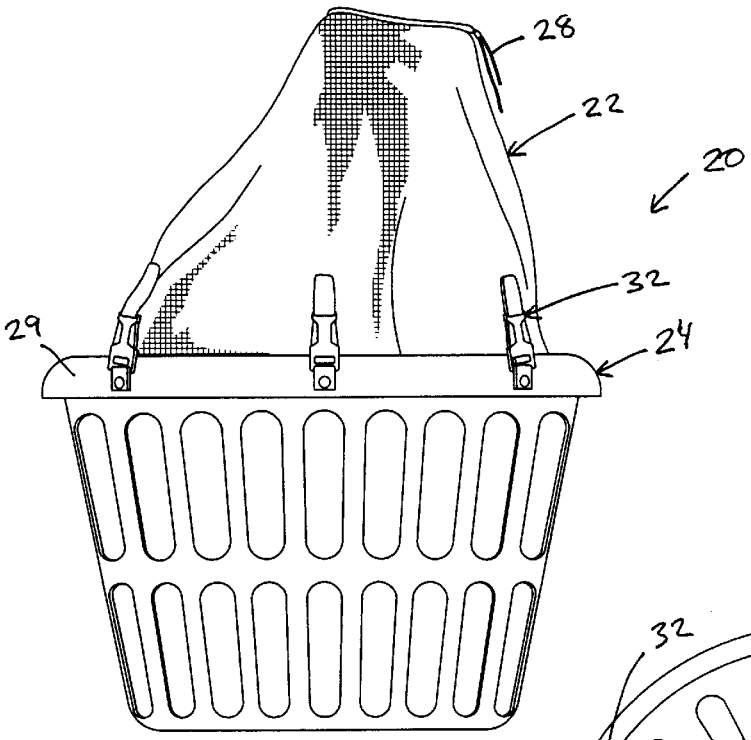
FIG. 1 is an elevational view of an extendible basket according to one aspect of the present invention shown with the extension material vertically extended.
Figure 2:
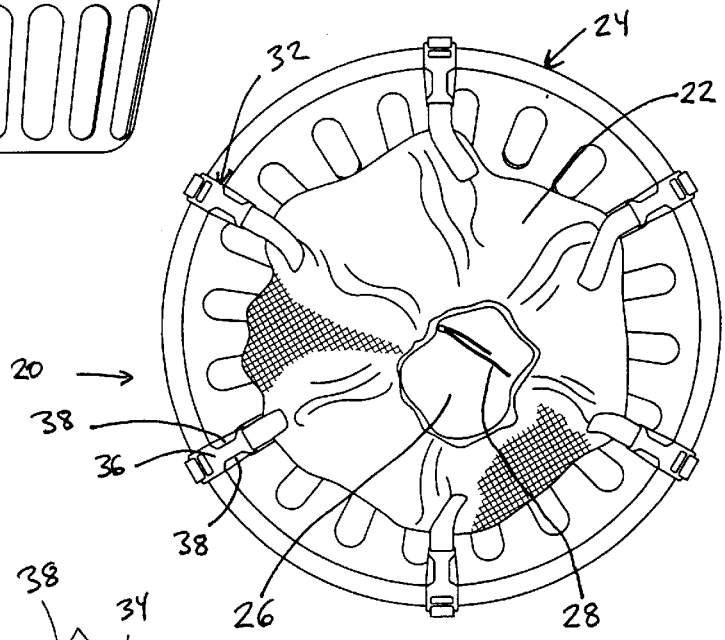
FIG. 2 is a plan view of the basket and extension material taken from above and illustrating the material attached to the basket, as well as a drawstring.

The present invention will now be described with reference to the accompanying drawings wherein like reference numerals correspond to like elements in the several drawings. An extendible basket 20 according to one aspect of the present invention is illustrated in the several figures. Extendible basket 20 includes an extension material 22 and a basket 24. Extension material 22 is generally secured to basket 24 around the perimeter of basket 24. Extension material 22 is preferably a fabric-type of material, such as mesh nylon, although other types of materials can be used as would be understood by one skilled in the art. Basket 24 can be any type and shape of basket, although the present invention finds particular applicability to laundry baskets. If basket 24 constitutes a laundry basket, any conventional type of laundry basket may be used, including baskets of different sizes and shapes from those depicted in the attached photos.

Extension material or fabric 22 includes an opening 26 at its top which has a drawstring 28 embedded about its perimeter (FIG. 8). Laundry or other items can be set in basket 24 by placing them through opening 26 and setting them in the body of basket 24. Because fabric 22 extends higher than the side walls of basket 24, laundry can be stacked in basket 24 to a higher extent without fear of the clothes falling out. After the basket has been sufficiently filled, drawstring 28 can be pulled as desired to constrict the size of opening 26 to secure the items in basket 24. A lock 30 on drawstring 28 allows the drawstring to easily be retained at the desired level of tightness. Lock 30 can be any conventional type of lock, such as those cord locks commonly found on drawstrings used in conjunction with sweatshirts and the like. Lock 30, as illustrated, is a barrel-shaped lock with an aperture that allows drawstring 28 to be pulled through it when the lock is squeezed together. When not squeezed, a spring in lock 30 causes a movable portion within the barrel to press against the drawstring and prevent movement of the lock 30 with respect to the drawstring. By sliding lock 30 adjacent the eyelet (not shown) out of which drawstring 28 exits, the length of the drawstring can be set in the same manner that the tightness of conventional sweatshirt hoods can be set.

Figure 3:
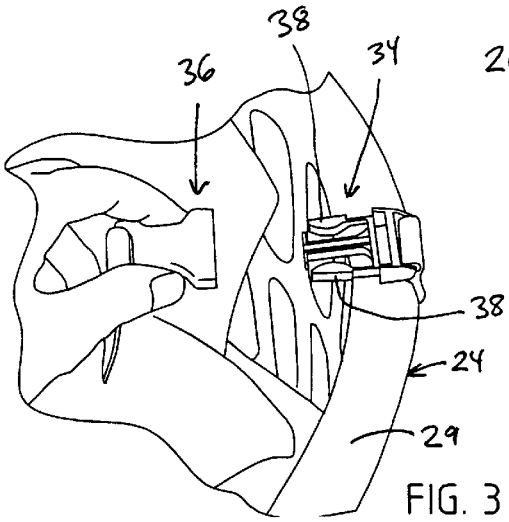
FIG. 3 is a perspective view of the releasable attachment mechanism for attaching and reattaching the extension material according to one embodiment of the present invention.

A plurality of attachment mechanisms 32 are fastened generally around the upper perimeter of basket 24. Attachment mechanisms 32 may be any conventional type of quick-release and reattachment mechanism. In the illustrated embodiment, attachment mechanisms 32 are clips manufactured by National Molding of Farmingdale, New York bearing the trade name "Stealth." Clips 32 include a male part 34 and a female part 36 which interlock together to selectively secure fabric 22 to basket 20. While male parts 34 are illustrated in the attached figures as being attached to basket 24 and female parts 36 are attached to fabric 22, the attachment of male and female parts to these structures can be reversed. Each male part 34 includes a pair of flexible prongs 38 which are flexible toward each other (FIG. 3). When squeezed together, flexible prongs 38 allow male part 34 to be retracted from a corresponding female part 36. When not squeezed together, male part 34 remains securely fastened to an attached female part 36. Fabric 22 can therefore be easily removed and reattached from basket 24. While the illustrated embodiment includes six attachment clips 32, it will be understood that this number can vary as necessary, particularly where basket 24 assumes a different size or shape.

Figure 4:
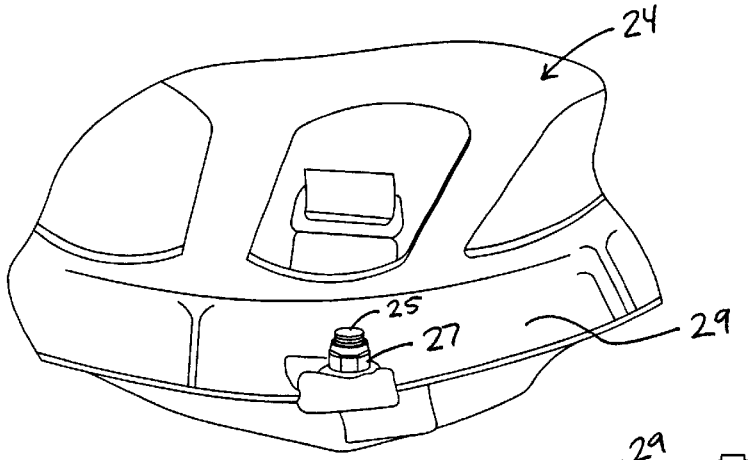
FIG. 4 is a perspective view of the underside of the basket illustrating a bolt and nut used to attach the extension material to the basket in one embodiment of the present invention.
Figure 5:
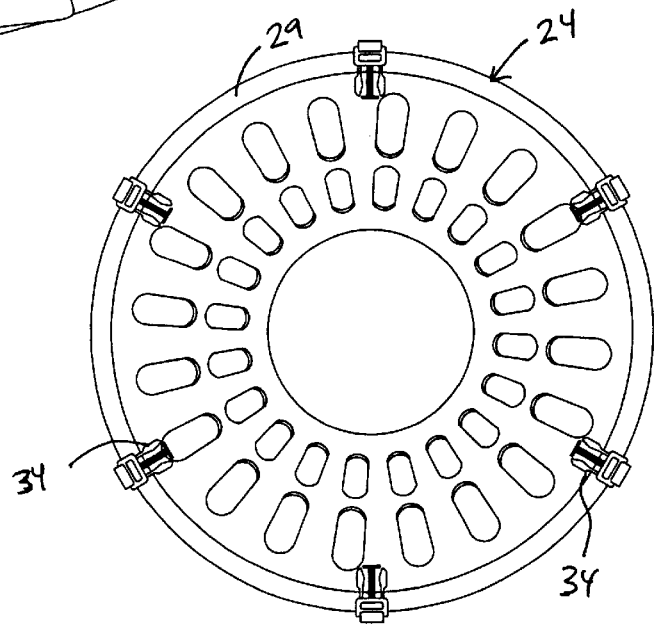
FIG. 5 is a plan view of the basket with the extension material removed from the basket.

In the illustrated embodiment, female parts 36 of clips 32 are attached to basket 24 by a fabric material which is secured via a bolt 25 and nut 27 to a rim 29 of the basket 24 (FIG. 4). The bolt is inserted through a hole drilled or otherwise cut in the rim 29 of the basket. Male parts 34 of clips 32 are attached to fabric 22 by way of a fabric material that is sewed, or otherwise secured, to material 22. Other ways of attaching clips 32 to basket 24 and material 22 are also possible.

Figure 6:
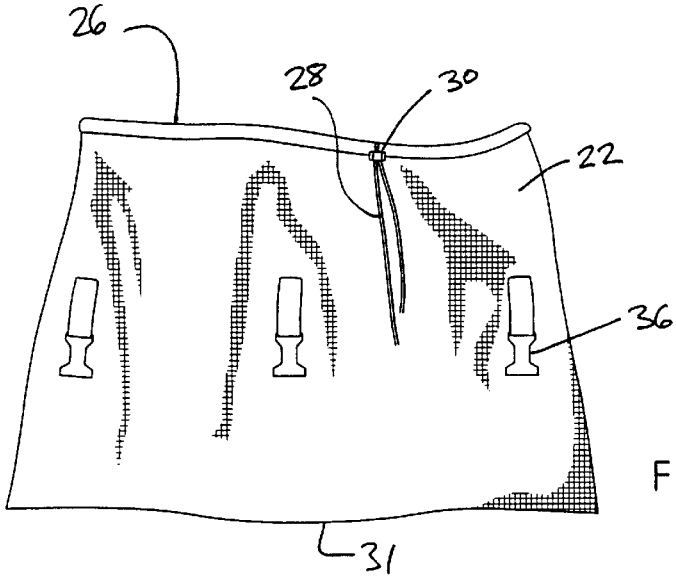
FIG. 6 is an elevational view of the extension material laid flat and separated from the basket.

As illustrated in FIG. 6, extension material 22 may be cut to have a narrower top opening 26 than its bottom opening 31. Alternatively, the top and bottom openings may be of the same size (when drawstring 28 is not tightened). Attachment mechanisms 32 are preferably attached to extension material 22 at a height such that the bottom of extension material 22 will lie in a lower plane than rim 29 when attached to basket 24. This helps prevent a gap forming between rim 29 and extension 22 out of which the laundry or other material carried in basket 24 might fall through. When viewed from above, extension material 22 has a generally circular shape, which matches the circular shape of basket 24. If a rectangle or other shaped basket is used, extension material 22 is preferably modified to correspond to the shape of the basket to which it is to be attached.

According to another aspect of the present invention, a kit may be provided for modifying a conventional basket to an extendible basket such as that illustrated in the attached figures. Such a kit could comprise fabric 22—including the attached clips 32 and drawstring—and means for attaching the fabric 22 to the basket (such as the appropriate number of nuts and bolts). The conventional basket could then be converted into an extendible basket according to the present invention by drilling holes into the rim of the basket and then securing the attachment clips 32 to the rim via the nuts and bolts. Fabric 22 can thereafter be easily attached and removed from basket 24 via clips 32. As an alternative to nuts and bolts, any other type of convenient fastener could be included in the kit. Such alternatives might include a looped piece of fabric that loops around the rim of the laundry basket and is secured in a loop by tying, Velcro, or other means. Another alternative might be to replace the clips 32 as illustrated with clips that directly clip onto the laundry basket such that a two-piece clip need not be used. Other variations are possible.

While the present invention has been described in terms of the attached drawings and the preferred embodiments depicted herein, it will be appreciated by those skilled in the art that various modifications to the described embodiments can be made without departing from the scope of the invention.

What is claimed is:

1. An extendable laundry basket comprising:

a generally rigid laundry basket having a bottom and at least one sidewall, the at least one sidewall extending upward from the bottom and defining an opening at an upper end of the at least one sidewall into which items may be inserted into the laundry basket, said laundry basket including a rim that extends around said opening and includes an outwardly extending rim portion extending around the upper end of the at least one sidewall;

a plurality of first fabric strips secured to said rim portion of said rim by way of fasteners extending through said rim portion and said first strips;

a plurality of first clip portions secured to said plurality of first fabric strips;

a fabric extension positioned partially within said laundry basket and generally about the rim and configured to extend outwardly from said opening away from said bottom, said fabric extension having a top opening and a bottom opening through which items may be inserted and placed on said bottom of said basket;

a plurality of second fabric strips secured to said fabric extension between said top and bottom openings; and a plurality of second clip portions secured to said plurality of second fabric strips, each of said second clip portions adapted to be releasably fastened to said first clip portions to releasably clip said fabric extension to said laundry basket, said fabric extension including an edge surrounding the bottom opening that is positioned within laundry basket inward of the at least one sidewall and below said rim when said first and second clip portions are fastened together.

2. The extendable basket of claim 1 wherein one of said first and second clip portions includes at least one flexible tab and the other of said first and second clip portions includes a receptacle for said flexible tab, said tab being flexible between a locking position in which said first and second clip portions are secured together and an unlocking position in which said first and second clip portions are not secured together.

3. The extendable basket of claim 1 further including a drawstring integrated within said fabric extension, said drawstring being positioned generally around said top opening, said drawstring adapted to reduce and enlarge the size of said top opening when tightened and loosened, respectively.

4. The extendable basket of claim 1 wherein said basket is a plastic laundry basket.

5. The extendable basket of claim 4 wherein said basket opening is circular.

6. The extendable basket of claim 3 wherein said drawstring includes a lock for selectively locking said drawstring at different levels of tightness.

7. The extendable basket of claim 6 wherein one of said fast and second clip portions includes at least one flexible tab and the other of said first and second clip portions includes a receptacle for said flexible tab, said tab being flexible between a locking position in which said first and second clip portions are secured together and an unlocking position in which said first and second clip portions are not secured together.

* * * * *